US005942718A

United States Patent [19]

Falquete et al.

[11] Patent Number: 5,942,718

[45] Date of Patent: Aug. 24, 1999

[54] ELECTRONIC DELAY DETONATOR

[75] Inventors: Marco Antonio Falquete; Reginaldo José Pellin, both of Curitiba, Brazil

[73] Assignee: IBO Industrias Quimicas LTDA., Barras Parana, Brazil

[21] Appl. No.: 08/981,393

[22] PCT Filed: Jun. 20, 1996

[86] PCT No.: PCT/BR96/00026

§ 371 Date: May 14, 1998

§ 102(e) Date: May 14, 1998

[87] PCT Pub. No.: WO97/01076

PCT Pub. Date: Jan. 9, 1997

[30] Foreign Application Priority Data

Jun. 23, 1995 [BR] Brazil ..... 9502995

[51] Int. Cl.[6] ..... F42C 11/00; F23Q 7/02; F42B 3/10

[52] U.S. Cl. ..... 102/207; 102/206; 102/202.5

[58] Field of Search ..... 102/207, 206, 102/202.5

[56] References Cited

U.S. PATENT DOCUMENTS

| | | | |
|---|---|---|---|
| 3,570,404 | 3/1971 | Pope | 102/207 |
| 3,780,425 | 12/1973 | Penn et al. | 438/55 |
| 3,781,176 | 12/1973 | Penn et al. | 136/212 |
| 3,905,298 | 9/1975 | Rehbock | 102/214 |
| 3,946,675 | 3/1976 | Stalfors | 102/207 |
| 4,095,998 | 6/1978 | Hanson | 136/208 |
| 4,372,211 | 2/1983 | Dante | 102/207 |
| 5,166,468 | 11/1992 | Atkeson | 102/207 |
| 5,173,569 | 12/1992 | Pallanck et al. | 102/210 |
| 5,206,456 | 4/1993 | Pracchia et al. | 102/207 |

*Primary Examiner*—Charles T. Jordan
*Assistant Examiner*—Theresa M. Wesson
*Attorney, Agent, or Firm*—The Kline Law Firm

[57] ABSTRACT

Patent of invention of an electronic delay detonator refers to a detonator meant to initiate explosive charges after an electronically predetermined delay time, transforming thermal energy generated by a heat source (2) into electrical energy through a miniaturized thermoelectronical battery (3), packed inside the detonator shell, placing the referred heating source over the heating face (3-A) of the battery (3) which has its opposing face unheated (3-B), being coupled in the detonator a nonelectrical initiation signal conductor medium (1) for the cap, having in the detonator shell the corresponding stages of a capacitor (4) for storage of electrical energy, an electronic timing circuit (5) which provokes the energization of the electric squib, following the detonation of a primary explosive (7) and a consequent detonation of the secondary explosive (8).

4 Claims, 2 Drawing Sheets

ELECTRONIC DELAY DETONATOR

BACKGROUND OF THE INVENTION

The present invention refers to an electronic delay detonator, protected against electromagnetic oscillations, intrinsically safe and with a time delay precision which would be impossible to be obtained through pyrotechnical charges.

As it is well known by explosive technicians, the delay detonators are commonly used to connect and start explosive charges in rock blasting, mining, tunnel openings, implosions, or controlled blastings.

Fundamentally, the delay detonators must present a predetermined time delay between initiation and consequent detonation of the connected explosive charge. The delay time is introduced to cause a series detonation of the explosive charges, in order to minimize the vibration caused by the blasting, besides propitiating an optimized utilization of energy generated by the explosive, achieving the desired efficiency.

Presently, the most used delay detonators make use, for obtaining delay time, of pyrotechnical columns with varied lengths, containing in its interior a mixture of solids capable of burning at a defined velocity.

In spite of many improvements performed along the years, in search of precise delay compositions, we can notice that the obtained precision is limited when compared to the possible precision obtainable through electronic circuits, which is the state of art technology in the field.

It is worth mentioning that electric sequence devices are used to supply a precise time delay through electric circuits, noting that the connections between the sequence device and the individual detonators are made with electric wires, which causes potential risks to the operator, due to stray currents, or electromagnetic induction caused by high tension lines, broadcast stations, radio transmitters and others. Besides such inconveniences, the electrical wires of the device must be connected to the detonators during all operation, what becomes difficult because of frequent rupture of wires by fragments of blasted material.

It is convenient to mention that the present technology has introduced nonelectric shock wave conducting tubes which eliminate the hazards associated with electric detonators, as it is described in Patent # PI 8104552.

Also known to the blasters is the use of detonating cords with a core of high explosive, connected to elements or blasting caps with pyrotechnical delays, noting that this technological aspect falls upon the aggravating circumstance of typical ground level noise of detonating cords, that contributes to the undesirable vibration level, besides reverting to the unpreciseness of the delay time.

Finally, we have the most advanced technology in the field that introduces electronic circuits in delay detonators.

Concerning the matter, is known the document # PI 8807665, published in Jun. 5th, 1990, that deals with a process to initiate an ignition system with electronically delayed action for explosive charges, in which is mentioned the possibility of energization of the electronic delay system through the melting of a fusible electrolyte, which does not generate electrical current when in the solid state, but it does so in the liquid state. This melting would be obtained by the heat generated by the detonation of an explosive, although the document #PI 8807665 neither presents elucidation concerning the materials that could be used for obtaining said energization, nor gives example of a well succeeded experiment with the utilization of the proposed technique. We come to the conclusion, therefore, that the subject was claimed based in general and vast principles. It is also known the document # PI 9202520, that utilizes a piezoelectrical transductor to transform the pressure generated by an explosion in the surroundings into electrical energy, which is used to activate a digital delay circuit. The electronic delay detonator, the object of the present invention, was secretly idealized and conceived with the purpose of characterizing a technological improvement in the field of safety and precision concerning time delays for detonators. Basically, the proposed detonator combines the intrinsical safety of nonelectrical initiation systems with the precision offered by electronical delay circuits.

SUMMARY OF THE INVENTION

One of the principles of the present invention consists in the transformation of the thermal energy generated by a heat source such as the one produced by a shock tube, by the burning of a pyrotechnical mixture or by the detonation of an explosive, in electrical energy, through a miniaturized thermoelectrical battery properly disposed in order to generate a difference in electrical potential when their faces are kept at different temperatures.

Consequently, the electric energy generated by the miniaturized thermoelectrical battery is used to activate an electronic delay circuit which, at the end of the programmed delay time, discharges the remaining energy into an electrical squib which is electrically activated, with which there is the detonation of the main explosive in the detonator.

Reference must be made that the possibility of conversion from thermal energy (heat) into electrical energy is well known—according to many authors in pertinent literature—since 1821 when T. J. Seebeck discovered that if two wires of different metals have their ends united, and there is a temperature difference in their junctions, there is generation of electrical current through the wires.

This effect, worldwide known as Seebeck effect, has been widely used for temperature measurements through devices called thermocouples. The typical thermocouples supply potential difference in the order of 50 to 80 $\mu$V/°C. and conversion efficiencies in the order of 1%.

Afterwards, with the institution of semiconductors materials, it became clear that the potential difference generated by the Seebeck effect is greater when the above mentioned semiconductors are used.

As typical semiconductors we have silicon, tellurium, germanium, selenium, as well as compounds from these elements.

In the presently available technology for electronic devices in general, there is the "doping" of semiconductors compounds with diminute quantities of other elements such us boron, phosphorus, sodium mid iodine, to modify its characteristics of electrical conductivity.

Using these semiconductor materials, it is possible to obtain potential differences in the order of 100 to 1000 $\mu$V/°C., and conversion efficiencies in the order of 3 to 13%.

The utilization of semiconductors has allowed the development of thermoelectrical batteries, devices that convert directly heat into electrical energy.

As typical use of these devices we can mention: generation of electricity in remote localities through burning of combustible material, and obtention of energy in spaceships that travel beyond the reach of solar radiation through heat generated by the decay of a radioactive isotope. It should be observed that conventional thermoelectrical batteries, applied for the above mentioned uses and for others, are great dimension devices, and designed for continuous use.

In the electronic delay detonator, object of the present invention, it is used a thermoelectric battery with peculiar characteristics, with diminute dimensions, developing small electric charges and it is used only once, being destroyed at the moment of detonation of the main explosive charge.

The present invention will be better understood with reference to the following drawings and their descriptions:

DETAILED DESCRIPTION OF THE INVENTION

Figure 1:
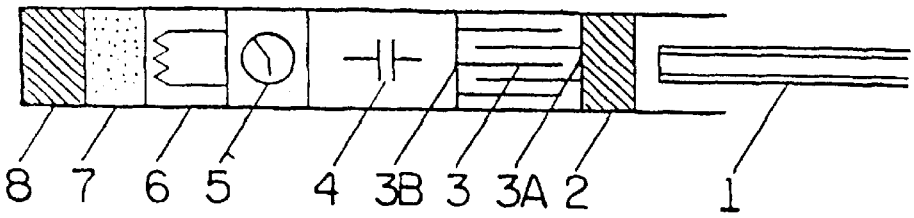
FIG. 1 shows a schematic view of the electronic delay detonator.

According to FIG. 1, the electronic delay detonator has a nonelectric conductor medium of initiation signal for the cap coupled which can be a shock tube or any other means for nonelectric initiation (1) and that, once initiated, provokes inside the detonator generation of thermal energy through a source of heat (2), that can be the burning of a pyrotechnical mixture, detonation of an explosive or the nonelectric initiation device itself in order to generate a temperature difference between the opposing faces (3-A, 3-B), of a miniaturized thermoelectrical battery (3), with which there is a generation of electrical energy, that can be used directly or stored in a capacitor (4), being then the electrical energy discharged through an electronic timing circuit (5), which, after the programmed delay time, will provoke the energization of a squib (6), occurring the detonation of the primary explosive (7), therefore, the detonation of a secondary explosive (8).

In the electronic delay detonator, object of the present invention, it is possible to eliminate the primary explosive (7), since there can be the direct initiation of the secondary explosive (8) by an electric discharge or by any other means of initiation.

Figure 2:
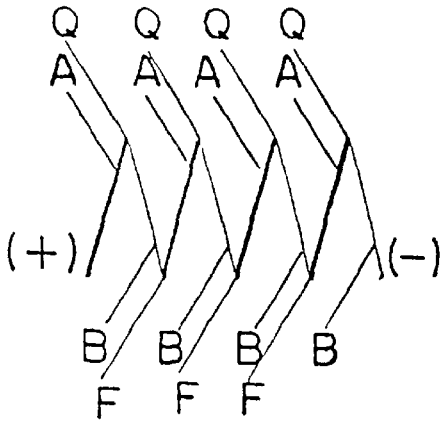
FIG. 2 shows the electrical diagram of the thermoelectrical battery.

According to FIG. 2, we can see the electric scheme of the miniaturized thermoelectrical battery, the electrical scheme being composed of a series connection of conductors composed of different materials (A,B) this connection being with heating junctions (Q) and junctions for maintenance of room temperature, noting Hint in the heating junctions (Q) is applied a temperature substantially higher than room temperature, The temperature applied to the heating junctions (Q) is generated by a heat source such as the burning of a pyrotechnical material, the detonation of an explosive or even the signal of nonelectric initiation over the face (3-A) of the miniaturized thermoelectrical battery (3) that corresponds to the heating junctions (Q). Heat being applied to only one face of the battery creates a temperature differential between the heated face and the opposing, unheated face of the battery.

Consequently, due to the temperature difference between the heating junctions (Q) on the heated face 3-A and the junctions for maintenance of room a temperature (F) on the heated face 3-B a difference of electrical potential between the positive (+) and the negative (−) terminals of the miniaturized thermoelectrical battery (3) is formed.

The thermoelectrical battery can be made of a connection of metals or metallic alloys, forming thermocouples in series. An example of an adequate thermocouple is the one formed by an chromium-nickel alloy and a copper-nickel alloy.

Figure 3:
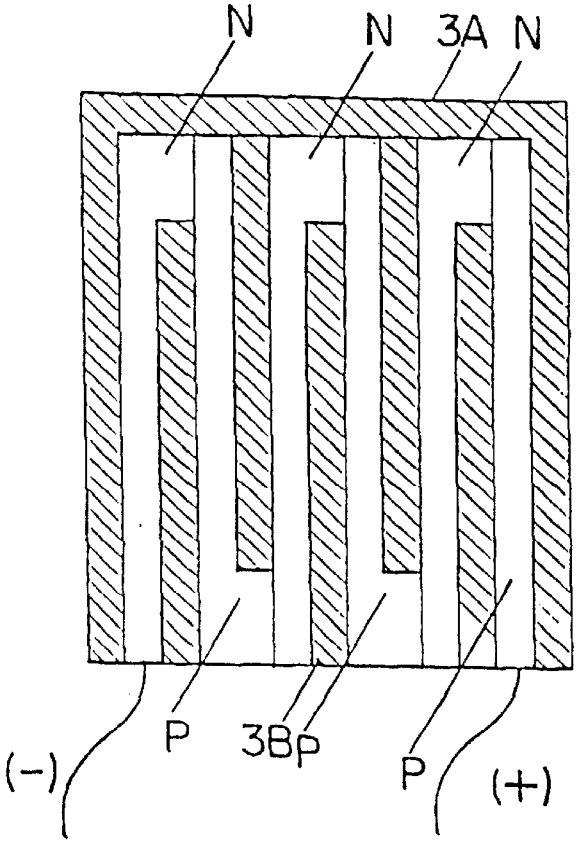
FIG. 3 shows a schematic view of the thermoelectrical battery.

The thermoelectrical battery can also be made of a serial connection of couples of "n" and "p" semiconductor materials according to FIG. 3.

In this option, the functioning of the thermoelectrical battery is similar to the functioning above mentioned and related to the metallic thermocouples.

As an example, among the semiconductor materials can be used: lead telluride, silicon-germanium alloys, and silicon Therefore, according to FIG. 3, we have a schematic representation of the miniaturized thermoelectrical batted composed by couples of semiconductors of the types "N" and "P" (N,P), observing in FIG. 3 the positive (+) and negative (−) terminals, and the faces of the thermoelectrical battery (3) corresponding to the heating junctions (3-A) and to the unheated junctions (3-B). Also in FIG. 3 the necessary electrical isolation in regions is made evident.

The miniaturized thermoelectrical battery, when composed of couples of type "n" and "p" semiconductors (N,P), can be obtained by the diffusion of doping elements such as phosphorus and boron over a wafer of silicon or another semiconductor material according to scheme evidenced in FIG. 3. The diffusion process is usual in the electronical industry.

Figure 4:
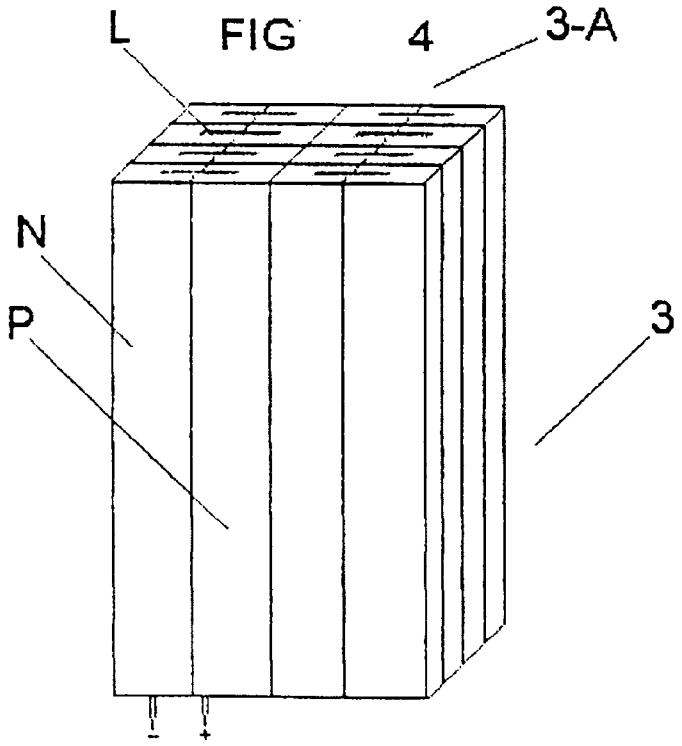
FIGS. 4 and 5 show miniaturized thermoelectrical battery.
Figure 5:
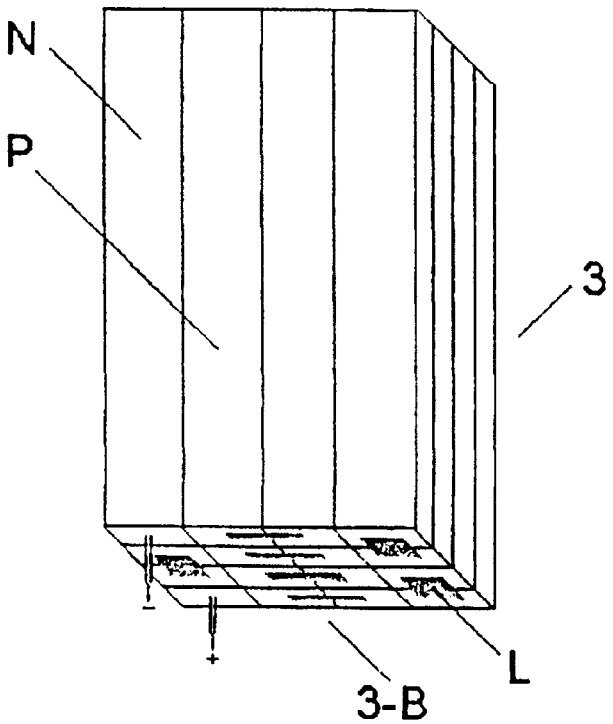

The miniaturized thermoelectrical battery can be made according to the exhibited in FIGS. 4 and 5, that show in superior and inferior perspectives the battery (3) which is composed, in this example, by mechanical connection of types "n" and "p" semiconductor threads (N,P) being said threads alternated and connected by metallic connections (L).

The electronic delay detonator, object of the present invention, is not limited to the employment of determined materials, nor to the employment of determined manufacture process, nor determined tension values, nor electrical currents, allowing any combination of adequate materials or processes which permit the manufacture of a diminute thermoelectrical battery that basically performs the direct conversion of heat into electricity through the Seebeck effect Also, it should be mentioned that in the present invention, there can be used as many couples of conductors or semiconductors as it is necessary for the desired effect.

It must be emphasized that the ELECTRONIC DELAY DETONATOR from this invention does not need an explosive detonation placed over the heated face of the miniaturized thermoelectrical battery, previous to the delay time, avoiding the premature rupture of the detonator shell and the possible interference over the explosive to be initiated Finally, it should be made clear that the miniaturized thermoelectrical battery (3) presents inherent safety, since it will only achieve the minimum tension for functioning when there is an accentuated difference of temperature between the heating face (3-A) and the unheated face (3-B) which is impossible to happen without being provoked.

We claim:

1. An electronic delay detonator comprising:

couples forming a nonelectric conducting signal medium for the initiation of a blasting cap, a detonator shell comprising corresponding stages of a capacitor for storage of electrical energy, an electronic timing circuit which provokes the energization of an electric squib following detonation of a primary explosive and a consequent detonation of a secondary explosives, a heat source disposed in an interior of said detonator over a heated face of a miniaturized thermoelectrical battery, an opposing face of said battery is not heated.

2. The electronic delay detonator according to claim 1 wherein:

said battery including a connection of electrical conductors composed of different materials, said connection with heated junctions and unheated junctions, respective to said heated face and said unheated face.

3. The electronic delay detonator according to claim 1 wherein:

said battery being formed by the serial connection of "N" and "P" semiconductor material couples with electrical isolation and metallic connections between said couples.

4. The electronic delay detonator according to claim 1 wherein:

battery directly converting heat into electricity by a Seebeck effect.

* * * * *